United States Patent [19]

Lerman

[11] 4,285,277

[45] Aug. 25, 1981

[54] LOW PROFILE GRENADE FUZE

[75] Inventor: Russell E. Lerman, Dover, N.J.

[73] Assignee: The United States of America as represented by the Secretary of the Army, Washington, D.C.

[21] Appl. No.: 33,670

[22] Filed: Apr. 26, 1979

[51] Int. Cl.[3] ..... F42B 11/42

[52] U.S. Cl. ..... 102/487; 102/223

[58] Field of Search ..... 102/64, 223, 224

[56] References Cited

U.S. PATENT DOCUMENTS

| | | | |
|---|---|---|---|
| 2,737,116 | 3/1956 | Manzolini | 102/64 |
| 3,498,223 | 3/1970 | Karl-Erik Andersson et al. | 102/64 |
| 3,685,451 | 8/1922 | Bovvring | 102/64 X |
| 3,823,669 | 7/1974 | Zacharin | 102/64 |
| 4,078,496 | 3/1978 | Kruger et al. | 102/64 |
| 4,167,905 | 9/1979 | Kosonocky et al. | 102/64 |

*Primary Examiner*—Peter A. Nelson

*Attorney, Agent, or Firm*—Nathan Edelberg; Robert P. Gibson; Harold H. Card, Jr.

[57] ABSTRACT

The present invention relates to a generally spherical hand grenade, wherein the fuze projects a lesser distance from the grenade body than prior art fuzes, this lower profile providing better aerodynamic and handling characteristics. The novel fuze includes two overlapping levers, the outermost one being a safety lever, which must rotate through a 90° arc from the fuze body before the fuze can be actuated to detonate the grenade.

9 Claims, 3 Drawing Figures

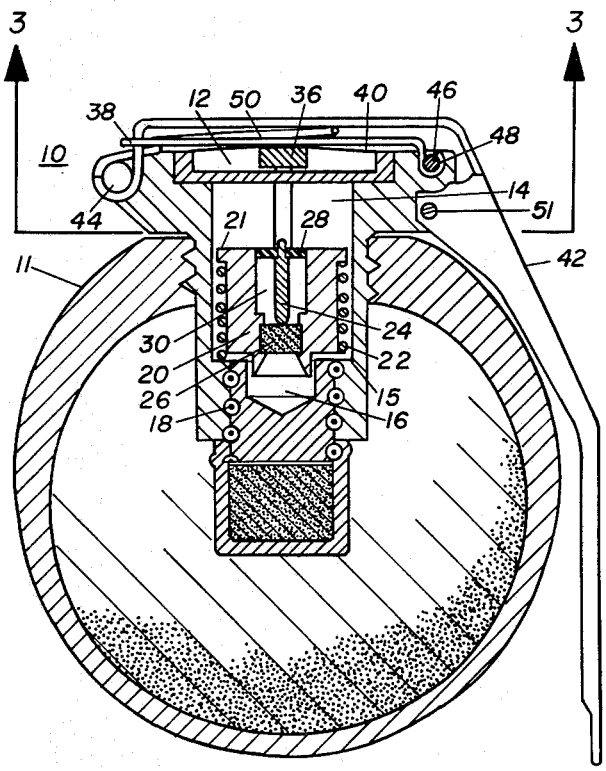

LOW PROFILE GRENADE FUZE

GOVERNMENTAL INTEREST

The invention described herein may be manufactured, used and licensed by or for the Government for governmental purposes without the payment to me of any royalties thereon.

BACKGROUND OF THE INVENTION

This invention relates to a low profile fuze for hand grenades and is intended to preserve the symmetry of the grenade body by avoiding the need for a long protruberance such as identified with fuzes known to the prior art. Explosive devices such as hand grenades typically include a safety lever to prevent arming the device before it is thrown toward a target. Actuation of the primer charge detonates the grenade, whereby a grenade can be accidentally detonated when the safety lever is not pressed firmly against the body of the hand grenade before it is thrown. This is particularly true where the operative relationship between the safety lever and the primer permits actuation of the primer with only small displacement of the lever away from the grenade external surface. If the grip of the throwing hand is loosened, the safety lever which is under tension of a spring may lift itself up so that the grenade is detonated unintentionally. In one particular fuze design, a distance of 3.5 cm between the safety lever and the body of the grenade may free the firing pin and result in unexpected detonation. It is a hazard of hand grenades known in the prior art that the fuze may be armed merely by rough handling. As a result, personnel may be exposed to unexpected and serious danger.

SUMMARY OF THE INVENTION

It is therefore an object of this invention to provide a fuze for use in hand grenades which will provide improved reliability and safety.

Another object is to provide a grenade fuze which cannot be actuated until a substantial displacement of the safety lever away from the grenade body occurs.

A further object is to seal the striker mechanism from the environment to protect the internal mechanism of the fuze.

A still further object is to provide a fuze profile extending only ⅓ the distance from the grenade external surface than present fuzes. These and other objects are accomplished by the present invention which comprises a new construction for explosive such as grenades to permit their handling with greater safety and reliability than prior designs. The present invention is simple in construction and dependable in operation. The invention comprises a double lever system which retains the detonating mechanism in a safe condition until the safety lever has moved through a 90° arc. This movement of the safety lever releases a detent lever, which in turn allows actuation of the detonating means. Use of two levers in the manner insures that the grenade will not detonate unless the safety lever has moved through an arc of 90° from the grenade.

BRIEF DESCRIPTION OF THE DRAWINGS

The invention may be seen from the accompanying drawings, wherein.

DESCRIPTION OF THE PREFERRED EMBODIMENT

Figure 1:
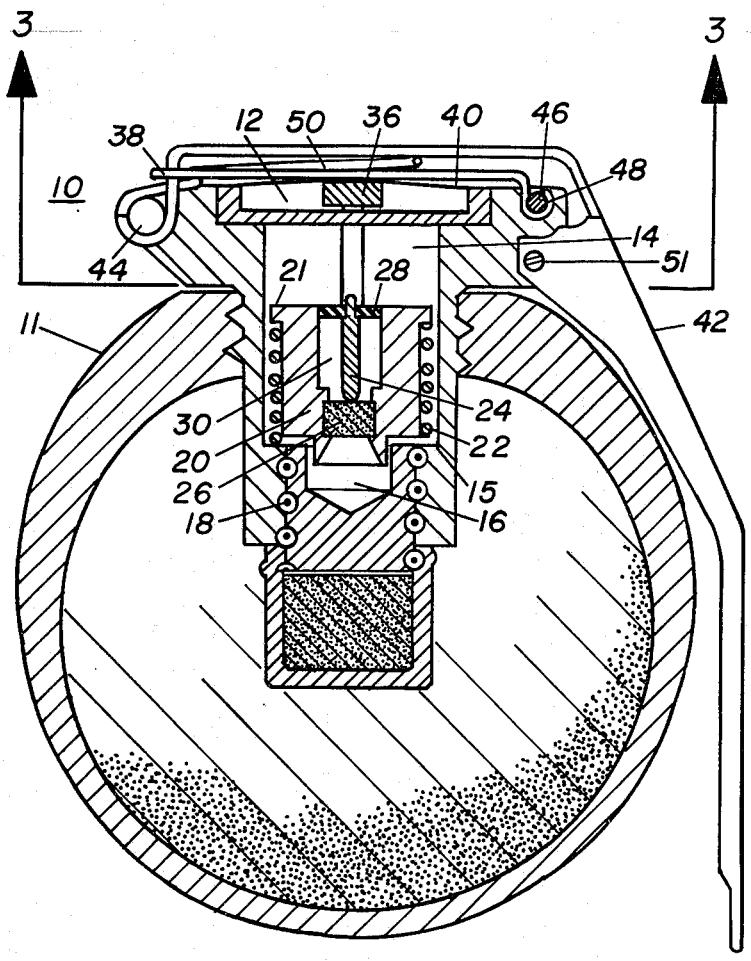
FIG. 1, a side elevational view, partly in cross-section, of the novel fuze assembled on a grenade.

Referring to FIG. 1, grenade 10 comprises a housing or body 11 having an explosive charge contained therein, and a fuze assembly secured thereon for detonating the main charge. The fuze assembly is of elongate, generally cylindrical form and has a detonator charge at the lower end thereof which is actuated by a convential delay cord 18 spirally wound within the fuze body. The cord is actuated by a primer 26 in a manner described below.

At the upper end of the fuze, as seen in FIG. 1, a first central bore 12 is provided in axial alignment with a second bore 14 of smaller diameter than bore 12 but longer in length. A flash hole or cavity 16 if formed as the lower end of bore 14 as seen in FIG. 1. The cavity is operatively related to a primer 26 so that actuation of the primer will cause actuation of delay cord 18, one end of which communicates with the cavity.

Primer 26 is contained within a translationally moveable spool-shaped mass 20 which functions as the primer holder and also contains a firing pin 24 centered within central bore 30 formed in mass 20. Mass 20 is substantially cylindrical in shape and is biased upwardly in FIG. 1 by a surrounding helical compression spring 22. One end of spring 22 bears against an annular projecting flange 21 formed on spool 20 and the other end of the spring bears against annular surface 15 within bore 14. Firing pin 24 is snugly fit to a closure disc or bushing 28 which is affixed within bore 30 under a predetermined force. The firing pin is snugly fit so that movement of the pin between the bushing 28 and primer 26 cannot occur in the absence of applied force to the firing pin. This offers limited restraint to pin 24 such as to avoid movement of the firing pin toward primer 26 through displacement during packing, shipment or handling of grenade 10.

Figure 2:
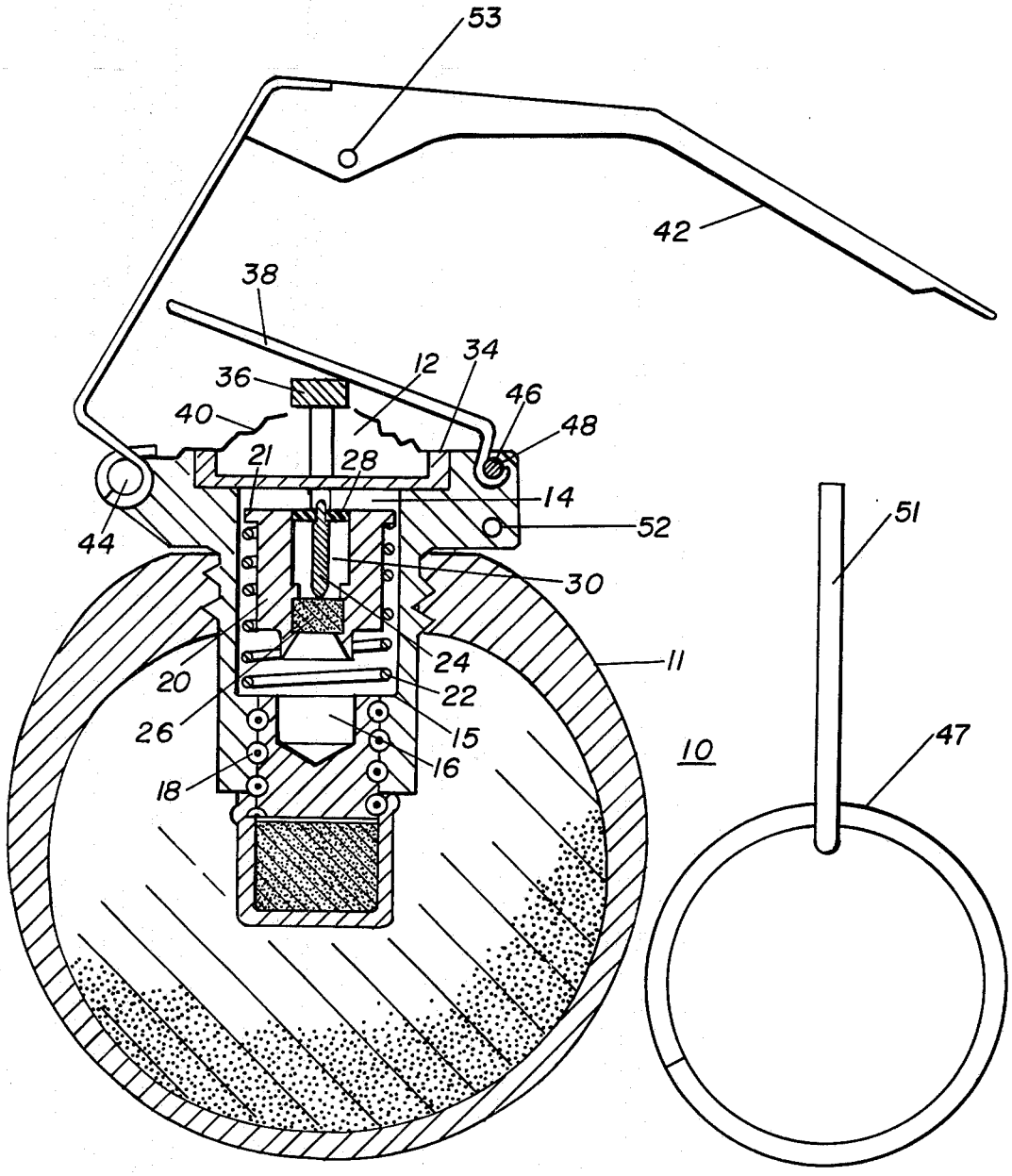
FIG. 2 is a view similar to FIG. 1 but with the novel fuze armed as the grenade is thrown, and FIG. 3, an isolated view taken along line 3—3 of FIG. 1.
Figure 3:
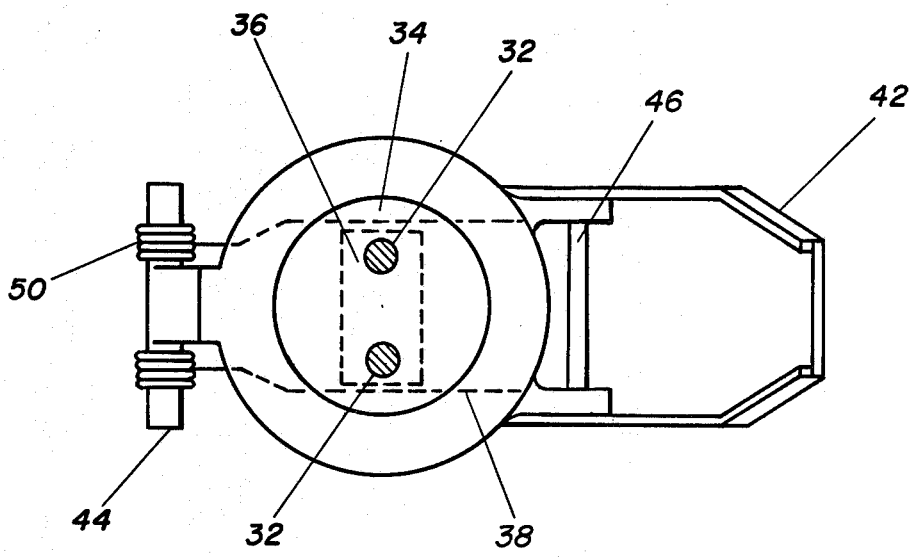

The novel fuze further includes impact force reaction means in the form of a dish-shaped generally flat plate 34 which functions as a striker plate as seen particularly in FIG. 2. Plate 34 is round and has a circular peripheral upturned flange at its outermost edge. The flange is dimensioned so as to be force-fit or otherwise securely affixed within bore 12 of the fuze.

The inventive structure further includes two integral projecting spacer rods 32, which pass through holes in the cupped striker plate 34 and are attached to a plate 36. The plate 36 provides a wide area of contact with the detent lever 38 maintaining the two spacer rods 32 aligned and (during the detonation sequence) rupturing the aluminum seal 40. The striker plate 34 is press, crimp or interference fitted into the first central bore 12. Sandwiched between the plate 36 and the detent lever 38 and sealing the first central bore 12 and the cupped striker plate 34 is a rupturable or displacable waterproof seal 40. The seal 40 may be a membrane of silicone rubber, polyester film or illustratively a thin flat sheet of aluminum foil about 2 mils thick to prevent moisture and other contaminants entering into the mechanism. Other suitable materials could be substituted for seal 40. Detent lever 38 is rotatable about pivot pin 46 in aperture 48.

One end of the safety lever 42 is pivotly attached to a pivot pin 44, and the center section of the safety lever 42 is held firmly attached to the fuze head 10 by a safety pin 51 which is slidably positioned in a fuze pin aperture 52 and projects through holes 53 in lever 42. The combination of the pivot pin 44 and the safety pin 51 is a restraint upon the safety lever 42 and is in turn a restraint upon the detent lever 38 which retains the primer holder 20 in a safe condition. The torsion spring 50 is wrapped around the pivot pin 44 and bears against the safety lever 42 and provides the force to propel the safety lever 42 about the pivot pin 44.

In operation, the grenade is grasped in such a manner as to remove the safety pin 51 from the fuze body 10 with a ring 47 and press the safety lever 42 down against the body of the grenade. The grenade is ready to be thrown. As soon as the grenade has been thrown, the safety lever 42 is free to swing outwardly by the exertion of pressure of the spring 50 appended to the pivot in 44. This causes the detent lever 38 to move in the opposite direction releasing the primer holder 20 which are both spring actuated. The movement upward of the primer holder 20 does not occur until the safety lever 42 has swung through at least a 90° arc from its stationary position allowing the detent lever 38 to swing upwards. When the safety lever 42 has swung through a 90° arc, compression spring 22 forces the primer holder 20 upward toward the striker plate 34, causing the plate 36 to rupture the aluminum seal 40. At approximately the same time the firing pin 24 impacts against the striker plate 34 which drives the firing pin 24 into the primer 26, thereby initiating the primer and exploding the grenade.

It will be understood that the inventive concept is not limited to the exact details of construction shown and described, since obvious modifications will occur to persons skilled in the art.

I claim:

1. A grenade comprising in combination:
- a housing for explosive;
- a tubular fuze body mounted on said housing, said body having an upper open end and a lower open end and containing a first bore and a second bore coaxially located therein;
- a striker plate fixedly mounted in said first bore;
- a spring biased primer holder positioned in said second bore and containing a primer charge and a firing pin, said firing pin being restrainably held therein spaced between said primer charge and said striker plate;
- a biased safety lever for controlling activation of said grenade pivotably attached to said fuze body upper end;
- a detent lever positioned below said safety lever and pivotably attached to said fuze body upper end, said detent lever being restrained by and pivoting diametrically opposite to said safety lever;
- a spacer means to prevent movement of said spring biased primer holder toward said striker plate until said detent lever is released;
- whereby release of said safety lever releases said detent lever permitting said spring biased primer holder to move said firing pin against said striker plate, initiating the primer.

2. A grenade as recited in claim 1 wherein:
- the spacer means comprises at least two rods each attached at their one end to said primer holder and at their other end to a plate, and said striker plate contains holes for passage of said rods.

3. A grenade as recited in claim 1 wherein:
- a rupturable seal is placed over said first bore to prevent contaminates from entering into the fuze body.

4. In a grenade for battlefield use;
- an external housing;
- an explosive charge within said housing:
  - fuze means on said housing for detonating said explosive charge,
  - seal means isolating said fuze means from atmosphere external of said housing, said seal means comprising a flat, thin, displaceable moisture-proof sheet; and
- moveable means operatively connected to said fuze means for displacing said sheet upon activation of said fuze means.

5. The structure in claim 4 above, wherein:
- said sheet consists of rupturable aluminum foil.

6. The structure in claim 4 above, wherein:
- said sheet comprises a silicone rubber membrane.

7. The structure in claim 4 above, wherein:
- said sheet comprises a polyester film.

8. A grenade comprising:
- a substantially spherical external housing;
- an explosive charge in said housing;
- fuze means on said housing for detonating said explosive charge, said fuze means including:
  - an elongate fuze body having an upper and a lower end,
  - a strike plate fixedly secured to said fuze upper end,
  - a translationally moveable primer holder containing a primer charge and a firing pin in spaced-apart relationship relative to each other,
  - restraining means operatively related to said primer holder to prevent said translational movement,
  - said restraining means including:
    - a first lever pivotally mounted on said housing for rotation about a first pivot axis,
    - a second lever pivotally mounted on said housing for rotation about a second pivot axis spaced apart from said first pivot axis, said second lever being adapted to restrain said primer holder against movement until said rotation about said second pivot axis occurs, and said first lever overlying said second lever and preventing said pivoted rotation of said second lever until said pivoted rotation of said first lever occurs about said first pivot axis.

9. The structure in claim 8 above, further including:
- seal means secured to said housing for isolating said fuze means from atmosphere external of said housing, said seal means comprising a flat, thin displaceable moisture-proof sheet.

* * * * *